US008626498B2

(12) United States Patent
Lee

(10) Patent No.: US 8,626,498 B2
(45) Date of Patent: Jan. 7, 2014

(54) VOICE ACTIVITY DETECTION BASED ON PLURAL VOICE ACTIVITY DETECTORS

(75) Inventor: Te-Won Lee, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 926 days.

(21) Appl. No.: 12/711,943

(22) Filed: Feb. 24, 2010

(65) Prior Publication Data

US 2011/0208520 A1 Aug. 25, 2011

(51) Int. Cl.
*G10L 25/93* (2013.01)

(52) U.S. Cl.
USPC ..... 704/210; 704/215

(58) Field of Classification Search
None
See application file for complete search history.

(56) References Cited

U.S. PATENT DOCUMENTS

| | | | | |
|---|---|---|---|---|
| 6,339,706 | B1 * | 1/2002 | Tillgren et al. | 455/419 |
| 6,453,285 | B1 | 9/2002 | Anderson et al. | |
| 6,618,701 | B2 * | 9/2003 | Piket et al. | 704/233 |
| 7,146,315 | B2 | 12/2006 | Balan et al. | |
| 7,162,248 | B2 | 1/2007 | Nagato et al. | |
| 7,174,022 | B1 | 2/2007 | Zhang et al. | |
| 7,203,643 | B2 | 4/2007 | Garudadri | |
| 7,925,510 | B2 * | 4/2011 | Creamer et al. | 704/270.1 |
| 8,244,528 | B2 * | 8/2012 | Niemisto et al. | 704/233 |
| 2002/0116186 | A1 * | 8/2002 | Strauss et al. | 704/233 |
| 2003/0179888 | A1 | 9/2003 | Burnett et al. | |
| 2003/0228023 | A1 | 12/2003 | Burnett et al. | |
| 2004/0122667 | A1 | 6/2004 | Lee et al. | |
| 2004/0234067 | A1 | 11/2004 | Allen et al. | |
| 2005/0033571 | A1 | 2/2005 | Huang et al. | |
| 2005/0102134 | A1 | 5/2005 | Manabe et al. | |
| 2005/0246166 | A1 | 11/2005 | Creamer et al. | |
| 2006/0120537 | A1 | 6/2006 | Burnett et al. | |
| 2007/0192094 | A1 * | 8/2007 | Garudadri | 704/231 |
| 2008/0249771 | A1 | 10/2008 | Wahab | |
| 2008/0317259 | A1 | 12/2008 | Zhang et al. | |
| 2009/0017879 | A1 * | 1/2009 | Tsfaty et al. | 455/574 |
| 2009/0125305 | A1 * | 5/2009 | Cho | 704/233 |
| 2009/0222264 | A1 * | 9/2009 | Pilati et al. | 704/233 |
| 2010/0332236 | A1 * | 12/2010 | Tan | 704/275 |
| 2011/0264449 | A1 * | 10/2011 | Sehlstedt | 704/226 |

FOREIGN PATENT DOCUMENTS

| | | | | |
|---|---|---|---|---|
| CN | 1591568 | A | 3/2005 | |
| CN | 1601604 | A | 3/2005 | |
| CN | 101548313 | A | 9/2009 | |
| EP | 1503368 | A1 | 2/2005 | |
| GB | 2430129 | A * | 3/2007 | G10L 11/02 |
| WO | WO2008058842 | A1 | 5/2008 | |

OTHER PUBLICATIONS

Mettala, "Bluetooth Protocol Architecture Version 1.0" Bluetooth White Paper, Document No. 1.C.120/1.0, Aug. 25, 1999.*

International Search Report and Written Opinion—PCT/US2010/060363, ISA/EPO—May 16, 2011.

* cited by examiner

*Primary Examiner* — Brian Albertalli
(74) *Attorney, Agent, or Firm* — Espartaco Diaz Hidalgo

(57) ABSTRACT

A voice activity detection (VAD) system includes a first voice activity detector, a second voice activity detector and control logic. The first voice activity detector is included in a device and produces a first VAD signal. The second voice activity detector is located externally to the device and produces a second VAD signal. The control logic combines the first and second VAD signals into a VAD output signal. Voice activity may be detected based on the VAD output signal. The second VAD signal can be represented as a flag included in a packet containing digitized audio. The packet can be transmitted to the device from the externally located VAD over a wireless link.

31 Claims, 6 Drawing Sheets

VOICE ACTIVITY DETECTION BASED ON PLURAL VOICE ACTIVITY DETECTORS

BACKGROUND

1. Field

The present disclosure pertains generally to speech processing, and more specifically, to voice activity detection.

2. Background

Voice activity detection (VAD) is a technique used in speech processing wherein the presence or absence of human speech (voice) is detected in portions of an audio signal, which may also contain music, noise, or other sounds. The main uses of VAD are in voice coding and speech recognition. VAD can facilitate speech processing, and can also be used to deactivate some processes during non-speech segments: it can avoid unnecessary coding/transmission of silence, saving on computation and network bandwidth.

VAD is an important enabling technology for a variety of speech-based applications. Customarily, VAD information is usually estimated locally in a single device, such as a communications handset, from an input audio signal.

VAD in a voice communications system should be able to detect voice in the presence of very diverse types of acoustic background noise. One difficulty in the detection of voice in noisy environments is the very low signal-to-noise ratios (SNRs) that are sometimes encountered. In these situations, it is often difficult to distinguish between voice and noise or other sounds using known VAD techniques.

SUMMARY

The techniques disclosed herein improve VAD in order to enhance speech processing, such as voice coding. The disclosed VAD techniques improve the accuracy and reliability of voice detection, and thus, improve functions that depend on VAD, such as noise reduction, echo cancellation, rate coding and the like. The VAD improvement is achieved by using VAD information that may be provided from one or more separate devices. The VAD information may be generated using multiple microphones or other sensor modalities that provide a more accurate VAD. The VAD information comes from multiple devices that may be connected to each other.

According to one aspect, a method of voice activity detection (VAD) includes receiving a first VAD signal from a first voice activity detector included in a device; receiving a second VAD signal from a second voice activity detector not included in the device; combining the first and second VAD signals into a VAD output signal; and detecting voice activity based on the VAD output signal.

According to another aspect, a system includes a first voice activity detector included in a device, configured to produce a first VAD signal; a second voice activity detector not included in the device, configured to produce a second VAD signal; and control logic, in communication with the first and second voice activity detectors, configured to combine the first and second VAD signals into a VAD output signal.

According to another aspect, a system includes first means for detecting voice activity at a first location; second means for detecting voice activity at a second location; and means for combining output from the first and second means into a VAD signal.

According to a further aspect, a computer-readable medium, embodying a set of instructions executable by one or more processors, includes code for receiving a first VAD signal from a first voice activity detector included in a device; code for receiving a second VAD signal from a second voice activity detector not included in the device; and code for combining the first and second VAD signals into a VAD output signal.

Other aspects, features, and advantages will be or will become apparent to one with skill in the art upon examination of the following figures and detailed description. It is intended that all such additional features, aspects, and advantages be included within this description and be protected by the accompanying claims.

BRIEF DESCRIPTION OF THE DRAWINGS

It is to be understood that the drawings are solely for purpose of illustration. Furthermore, the components in the figures are not necessarily to scale, emphasis instead being placed upon illustrating the principles of the techniques described herein. In the figures, like reference numerals designate corresponding parts throughout the different views.

DETAILED DESCRIPTION

Figure 1:
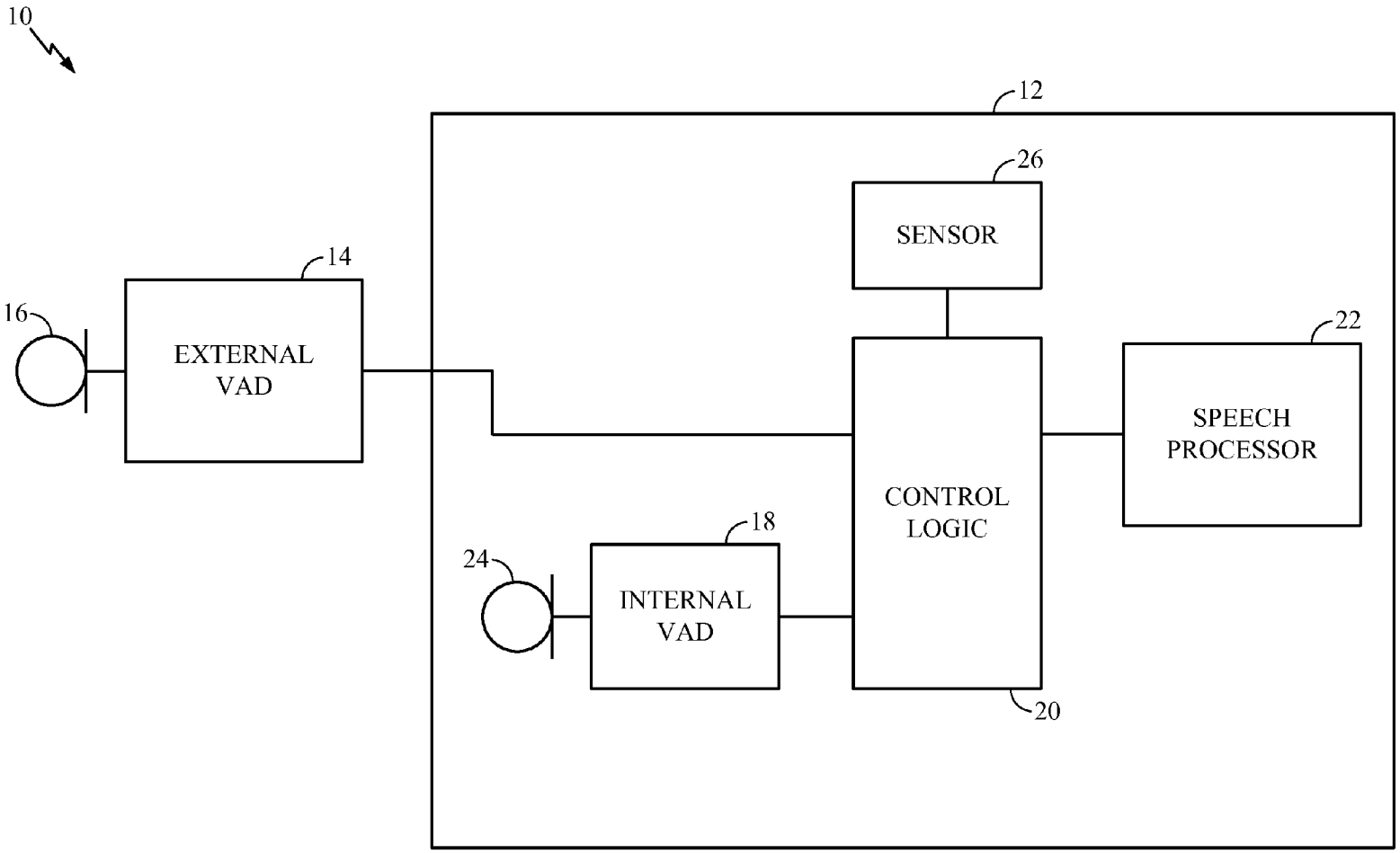
FIG. 1 is a diagram of an exemplary voice activity detection (VAD) system.

The following detailed description, which references to and incorporates the drawings, describes and illustrates one or more specific embodiments. These embodiments, offered not to limit but only to exemplify and teach, are shown and described in sufficient detail to enable those skilled in the art to practice what is claimed. Thus, for the sake of brevity, the description may omit certain information known to those of skill in the art.

The word "exemplary" is used throughout this disclosure to mean "serving as an example, instance, or illustration." Anything described herein as "exemplary" is not necessarily to be construed as preferred or advantageous over other approaches or features.

In conventional speech processing system, voice activity detection (VAD) is typically estimated from an audio input signal such as a microphone signal, e.g., a microphone signal of a cell phone. VAD is an important function in many speech processing devices, such as vocoders and speech recognition devices.

As disclosed herein, a voice activity detector is located in a separate device that may be connected to a primary device (e.g., computer, cell phone, other handheld device or the like). Within the primary device, the VAD information from the separate device may be further processed and speech processing takes place.

For example, a Bluetooth headset may be connected to a cell phone. A vocoder in the cell phone may include a VAD algorithm that normally uses the cell phone's microphone input signal. When the Bluetooth headset is actively connected to the cell phone, the microphone signal of the Bluetooth headset is used by the VAD algorithm, instead of or in combination with the cell phone's microphone signal. If the Bluetooth headset uses additional information, such as multiple microphones, bone conduction or skin vibration microphones, or electro-magnetic (EM) Doppler radar signals to accurately estimate the VAD of a user (target), then this external VAD information is also used in the cell phone's vocoder to improve the performance of the vocoder. The external VAD information can be used to control vocoder functions, such as noise estimation update, echo cancellation (EC), rate-control, and the like. The external VAD signal can be a 1-bit signal from the headset to the handset and can be either encoded into an audio signal transmitted to the handset or it can be embedded into a Bluetooth packet as header information. The receiving handset is configured to decode this external VAD signal and then use it in the vocoder.

With bone conduction and skin vibration microphones, when a user talks, the user's skin and skull bones vibrate, and the microphone converts the skin vibration into analog electrical signal. Bone conduction and skin vibration microphones provide advantage in noisy environments because the voice signal is not passed through the air from mouth to the headset, as in other headsets using conventional microphones. Thus, ambient noise is effectively eliminated from the audio signal passed to the handset.

For voice activity detection using an acoustic Doppler radar device, a sensor is used to detect the dynamic status of a speaker's mouth. At the frequencies of operation, background noises are largely attenuated, rendering the device robust to external acoustic noises in most operating conditions. Unlike the other non-acoustic sensors, e.g., bone conduction and skin vibration sensors, the radar device need not be taped or attached to the speaker, making it more acceptable in most situations.

Where the external VAD signal is a 1-bit flag of a Bluetooth (BT) packet, the 1-bit flag can be included in the trailer of the access code or the type field in each Bluetooth packet header. Alternatively, the 1-bit VAD flag can be included in a designated location of the payload section of the Bluetooth packet. In either case, the VAD signal is a single bit flag included in each BT packet. When the flag is set, it indicates that the Bluetooth packet includes voice, detected by the external VAD. When the VAD flag is not set, voice is not present in the audio payload of the Bluetooth packet. Sending just one 1-bit flag embedded in a BT header provides a discrete signal (1 bit per block or BT packet). A flag having more bits or multiple flags representing the external VAD signal may alternatively be used.

The external VAD reduces speech processing errors that are often experienced in traditional VAD, particularly in low signal-to-noise-ratio (SNR) scenarios, in non-stationary noise and competing voices cases, and other cases where voice may be present. In addition, a target voice can be identified and the external VAD is able to provide a reliable estimation of target voice activity. A more reliable and accurate VAD can be used to improve the following speech processing functions: noise reduction (NR), i.e., with more reliable VAD, higher NR may be performed in non-voice segments; voice and non-voiced segment estimation; echo cancellation (EC), improved double detection schemes; and rate coding improvements which allow more aggressive rate coding schemes (lower rate for non-voice segments).

FIG. 1 is a diagram of an exemplary voice activity detection system 10. The system 10 includes a device 12, and an external voice activity detector (VAD) 14 connected to an acoustic sensor, such as one or more microphones 16. The acoustic sensor associated with the external VAD 14 can alternatively be or additionally include a one or more bone conduction or skin vibration microphones, or electro-magnetic (EM) Doppler radar devices, or any suitable combination of such sensors and/or microphones.

The device 12 includes an internal voice activity detector (VAD) 18, control logic 20, a speech processor 22, such as a vocoder, one or more microphones 24, and a sensor 26. The device 12 may be any suitable electronic device configured to perform the functions disclosed herein, such as a computer, a laptop, a communications device, such as a telephone, cellular phone, personal digital assistant (PDA), a gaming device or the like.

The internal VAD 18 may be any suitable device that implements a VAD algorithm, and may be integrated as part of the speech processor 22. The control logic 20 is responsive to VAD signals from the external VAD 14, the internal VAD 18 and the sensor 26.

The sensor 26 senses environmental operating conditions and provides input to the control logic 20, based on such conditions, that is used to determine the VAD output signal generated by the control logic 20. The sensor 26 may output control inputs that are based on one or more environmental operating conditions, such as ambient noise level, signal-to-noise ratios (SNRs) measured, for example, at the device 12 and/or proximate to or at the external VAD 14. The sensor 26 may include one or both of the microphones 16, 24.

The external VAD 14 is located externally to the device 12 and produces an external VAD signal, which is received by the control logic 20. The external VAD 14 may be any suitable device that implements a VAD algorithm. The external VAD 14 may be included in a separate device, such as a headset, speakerphone, car-kit, or the like.

The external VAD 14 and device 12 may communicate with each other using any suitable communication medium and protocol. The connection between the external VAD 14 and device 12 can be a wired connection or a wireless connection, such as a radio frequency (RF) or infrared (IR) link, e.g., a Bluetooth link, as defined by the Bluetooth specification, available at www.bluetooth.com. The external VAD signal can be encoded in audio data transferred to the device 12, or it can be a flag included in an audio packet, such as Bluetooth packet, as described above.

The control logic 20 may combine the external and internal VAD signals into a VAD output signal. The control logic 20 can combine the input VAD signals by weighting each of the VAD signals using weighting factors that are based on the environmental inputs from the sensor 26. Some examples of weighting factors and methods that may be employed are described below in connection with FIGS. 3 and 4. Voice activity can be detected based on the VAD output signal. In the example shown in FIG. 1, the VAD output signal is provided to the speech processor 22, which compares the VAD output signal to a threshold to determine whether voice is present in the audio signal being processed by the speech processor 22.

The speech processor 22 can be any type of speech processing component that relies on voice activity detection, such as a vocoder. For example, the speech processor 22 can be an enhanced variable rate codec (EVRC), such as the EVRC specified in "Enhanced Variable Rate Codec, Speech Service Option 3 for Wideband Spread Spectrum Digital Systems", or the 3GPP2, No. 3GPP2 C.S0014-A, dated April, 2004.

The VAD algorithm(s) used by the internal and external VADs 18, 14 can be, for example, any suitable VAD algorithm currently known to those skilled in the art. For example, an energy-based VAD algorithm may be used. This type of VAD algorithm computes signal energy and compares the signal energy level to a threshold to determine voice activity. A zero-crossing count type VAD algorithm may also be use. This type of VAD algorithm determines the presence of voice by counting the number of zero crossings per frame as an input audio signal fluctuates from positives to negatives and vice versa. A certain threshold of zero-crossings may be used to indicate voice activity. Also, pitch estimation and detection algorithms can be used to detect voice activity, as well as VAD algorithms that compute formants and/or cepstral coefficient to indicate the presence of voice. Other VAD algorithms or any suitable combination of the above VAD algorithms may alternatively/additionally be employed by the internal and external VADs 18, 14.

Figure 2:
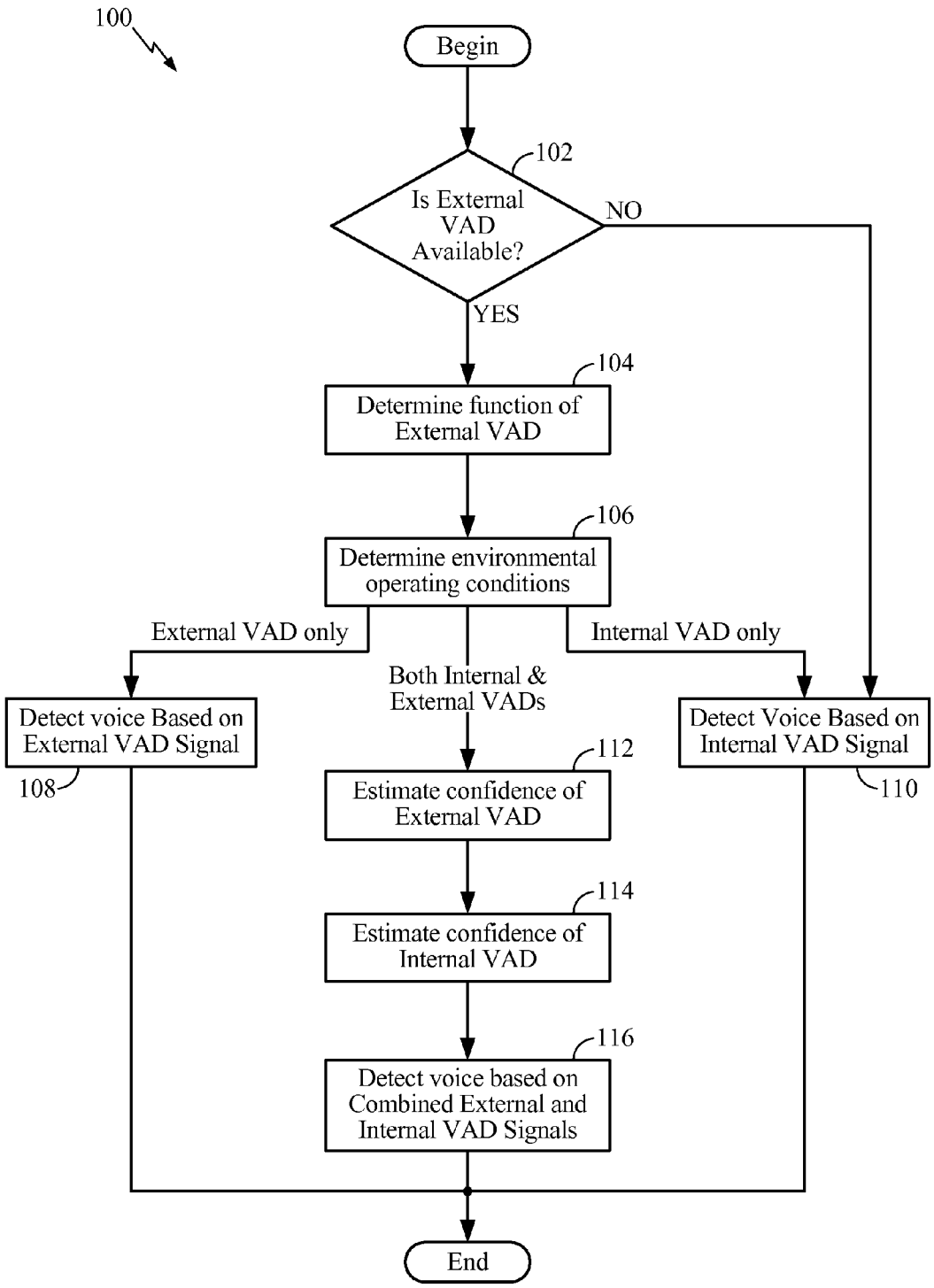
FIG. 2 is a flowchart illustrating a method of detecting voice activity using the system of FIG. 1

FIG. 2 is a flowchart 100 illustrating a method of detecting voice activity using the system 10 of FIG. 1. In decision block 102, a check is made to determine whether an external VAD, e.g., external VAD 14, is available. If not, the method proceeds to block 110, where voice is detected based on the VAD signal output from an internal VAD, e.g., the internal VAD 18.

If an external VAD is available, the method proceeds to block 104. In block 104, the function of the external VAD is determined. The function of the external VAD is based on the type of acoustic sensor employed by the external VAD, for example, a bone conduction microphone, an audio microphone, a skin vibration sensor, an array of microphones, a Doppler radar device, or any suitable combination of the foregoing.

In block 106, the environmental operating conditions are determined. The conditions may include environmental conditions in the vicinity of or at the external VAD or the device. For example, the operating conditions may include measured background noise at the location of the external VAD and/or the device. The operating condition may also include the signal-to-noise ratio (SNR) measured at the external VAD, the device or both locations.

Based on the environmental operating conditions, the control logic may determine that only the VAD signal from the external VAD is used (block 108), only the VAD signal from the internal VAD is used (block 110), or that both the external and internal VAD signals are used (blocks 112-116) in determining a VAD output signal.

If only the external VAD signal is used, then the voice signal is detected based on the external VAD signal only (block 108). If only the internal VAD signal is used, then the voice signal is detected based on the internal VAD signal only (block 110).

Figure 3:
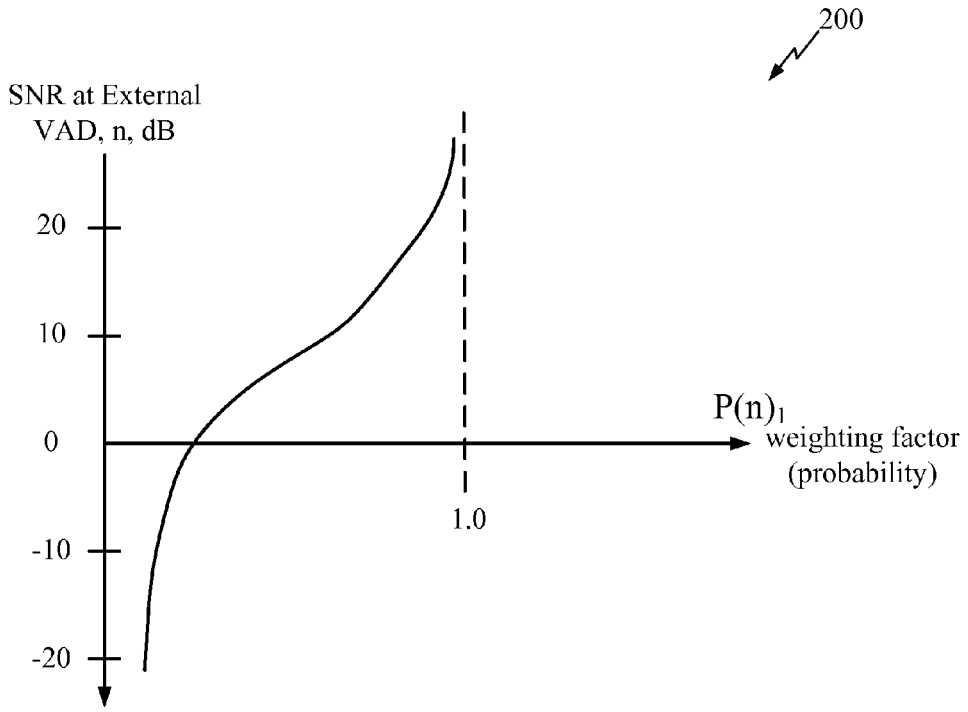
FIG. 3 is an exemplary graph showing VAD signal weighting factors as a function of SNR at the external VAD shown in FIG. 1.
Figure 4:
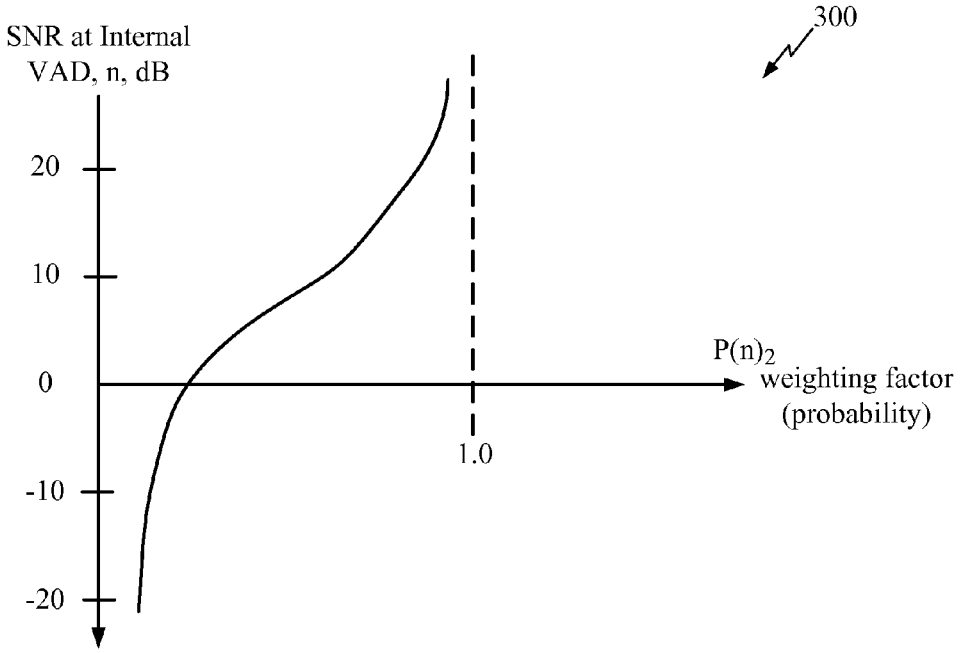
FIG. 4 is an exemplary graph showing VAD signal weighting factors as a function of SNR at the internal VAD shown in FIG. 1.

If the operating condition warrant use of both internal and external VAD signals, for example, in cases where there is relatively large amounts of ambient background noise at the internal VAD location, then the confidence of the external VAD signal is estimated (block 112) and the confidence of the internal VAD signal is also estimated (block 114). The confidence levels can be calculated, for example, by determining a weighting factor (e.g., probability value) for each VAD signal as a function of the measured SNR or another environmental condition at each VAD location, respectively. The probability values can then be applied to the respective VAD signals as weighting values, e.g., by multiplying the VAD signals by the probability values, respectively, to obtain a corresponding confidence level. Each probability value may be a value between zero and one. FIGS. 3-4 show graphs depicting exemplary relationships between the probability values and the SNRs measured at each location. The weighting factors may also be based on environmental conditions other than SNRs.

In block 116, voice activity is detected by the control logic based on combined external and internal VAD signals. The combined VAD signals may be the sum of the weighted external and internal VAD signals, for example:

$$Y=P_1*V_1+P_2*V_2, \quad \text{Eq. 1}$$

where Y=a VAD output signal, $P_1$=an external probability value, $V_1$=the external VAD signal, $P_2$=an internal probability value, and $V_2$=the internal VAD signal. Each term $P_1*V_1$ and $P_2*V_2$ in Eq. 1 represents a confidence level. In some circumstances, the external and internal probability values $P_1$, $P_2$ are each within the range of 0 to 1, and additionally, the sum of probability values may be required to be the value of one. The VAD output signal is compared to a threshold value to determine whether voice activity is present in the audio signal. If the VAD output signal exceeds, for example, the threshold value, then voice is present in the audio signal. Conversely, if the VAD output signal is less than or equal to the threshold value, by way of example, then voice is not present in the audio signal. Other threshold comparisons may be used. Another exemplary weighting formula that may be used is expressed as:

$$Y=P*V_1+(1-P)*V_2, \quad \text{Eq. 2}$$

where P is either $P_1$ or $P_2$. By assigning a value to P, the value of (1−P) is obtained as the remaining weighting factor for $V_2$, to compute Y.

FIG. 3 is a graph 200 showing an exemplary relationship between an example external VAD signal weighting factor, $P_1$, and an environmental operating condition, namely, the SNR, n, measured at the external VAD 14 shown in FIG. 1. The measured SNR is represented on the vertical axis, and the probability values are represented on the horizontal axis. Generally, in this example, the SNR has a direct relationship with the external VAD signal weighting factor, i.e., as the SNR increases, the weighting factor generally increases, and conversely, as the SNR decreases, so does the weighting factor.

FIG. 4 is a graph 300 showing an exemplary relationship between an example internal VAD signal weighting factor, $P_2$, and an environmental operating condition, namely, the SNR, n, measured at the internal VAD 18 shown in FIG. 1. The measured SNR is represented on the vertical axis, and the probability values are represented on the horizontal axis. Generally, in this example, the SNR has a direct relationship with the internal VAD signal weighting factor, i.e., as the SNR increases, the weighting factor generally increases, and conversely, as the SNR decreases, so does the weighting factor.

The graphs 200, 300 show only one set of example relationships. Different probability functions can be employed for either the external or internal VAD. Although FIGS. 3-4 illustrate generally sigmoidal relationships between the weighting factors and the measured environmental operating conditions (e.g., the SNRs), other relationships, such as a linear relationship, may be used to derive the weighting factor(s) from the measured environmental condition(s).

In situations where the external and internal VAD weighting factors are related, such as given in Equation 2 above, one graph can be used to illustrate the relationship between the environmental operating condition and the weighting factor, and value of the other weight factor can be directly computed. For example, using Eq. 2, the second weighting factor can be computed from 1-P.

Generally, the relationship between $P_1$ and $P_2$ reflects an estimation of which VAD is more reliably determining voice activity, either the internal VAD or external VAD. This depends mostly on the characteristics of the VADs. For example, for an internal VAD that may depends upon microphone input signals, the reliability of the internal VAD signal is highly dependent on the measure SNR at the device, and the graph of FIG. 4 may apply. However, at an external device, e.g., a wireless headset, a bone conduction microphone may be used. When a bone conduction microphone is used, the reliability of the external VAD signal, for example, does not depend necessarily on the SNR, but instead on how accurately the bone conduction sensor touches the skin area of the user and accurately detects the vibrations and bone conduction. In this case, the external weighting factor $P_1$ would not necessarily be a function of SNR, as shown in FIG. 3, but rather the level of the bone conduction sensor contact to the user's skin. The more the sensor touches the user's skin, the greater the value of $P_1$.

In systems combining bone conduction sensors, located for example in an external device, such as a headset, and audio microphones, located for example in the primary device, such as a handset, the $P_1$ may be related to environmental operating conditions such that $P_1$ (for the external bone conduction sensor) depends on usability and wear of the external device, where the sensor touches or in some use cases does not touch the user's skin. This condition may be estimated based on historical data and/or statistics based on the operation of the internal and or external VADs. P2 for the internal VAD signal may be based on the measured SNR.

The weighting factors and probability values described above, including those illustrated in the graphs 200, 300 can be stored in a look-up table.

Figure 5:
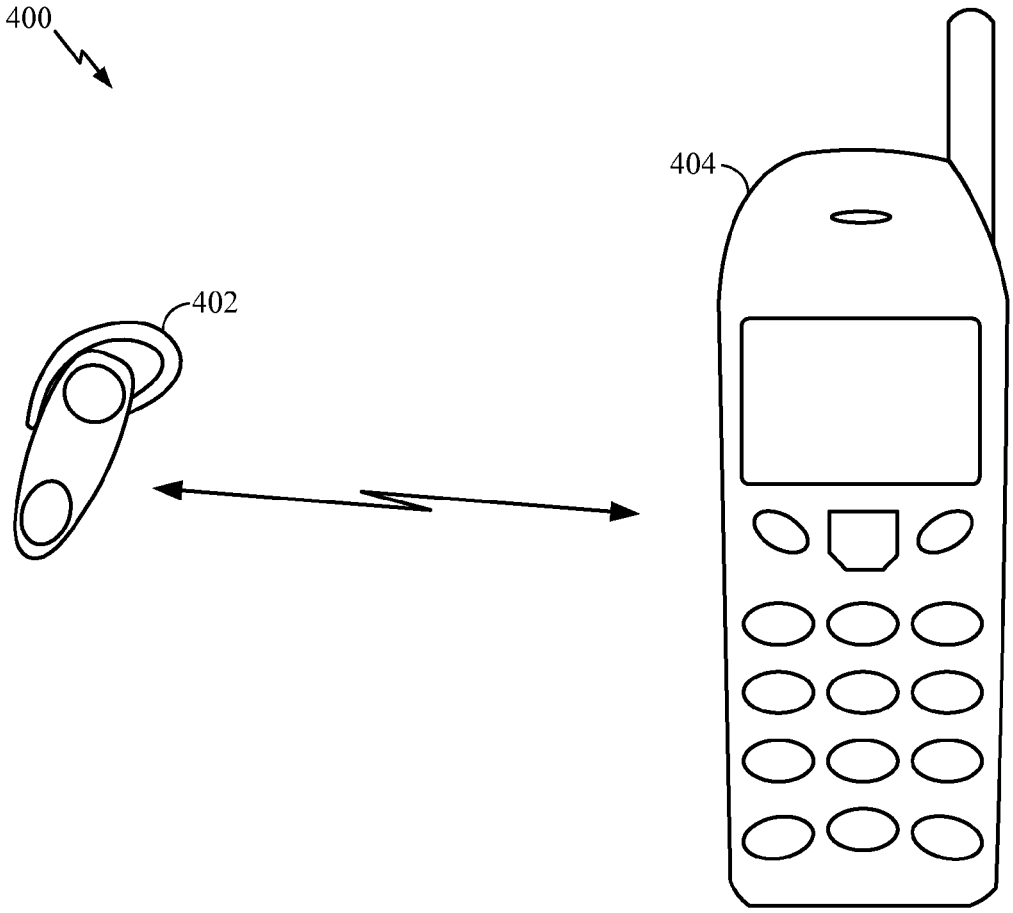
FIG. 5 is a diagram showing an exemplary headset/handset combination including a VAD system.

FIG. 5 is a diagram showing an exemplary headset/handset combination 400 including a headset 402 and handset 404 that incorporates the functionality of the VAD system 10. The system 10 of FIG. 1 can be employed in at least several different operational scenarios. In the example shown in FIG. 5, the functions of VAD system 10 are incorporated in 400 headset/handset combination, as described in greater detail herein below. In this environment, external VAD information is measured in the headset 402. This measurement can be from an additional microphone or microphones, a jaw vibration microphone/sensor, or an electro-magnetic (EM), e.g., Doppler radar sensor, any of which are included in the headset 402. This external VAD information is then sent to the handset 404 in either binary or continuous signal form as an external VAD signal. The external VAD information can be either encoded into the audio data stream or embedded into the header of the packet sent. The VAD information is then decoded in the handset 404 and used for further processing in particular to improve the performance of a vocoder, such as an EVRC.

A Bluetooth wireless link is preferably used between the headset 402 and handset 404. In configurations where the external VAD signal is included in the packet headers, the external VAD signal is a 1-bit flag of a Bluetooth (BT) packet, the 1-bit flag can be included in the trailer of the access code or the type field in each Bluetooth packet header. Alternatively, the 1-bit VAD flag can be included in a designated location of the payload section of the Bluetooth packet. In either case, the VAD signal is a single bit flag included in each BT packet. When the flag is set, it indicates that the Bluetooth packet includes voice, detected by the external VAD. When the VAD flag is not set, voice is not present in the audio payload of the Bluetooth packet. Sending just one 1-bit flag embedded in a BT header provides a discrete signal (1 bit per block or BT packet). A flag having more bits or multiple flags representing the external VAD signal may alternatively be used.

A continuous VAD signal may be encoded into the audio stream using any suitable audio watermarking technique. Using audio watermarking, the VAD signal is modulated onto the audio data in an inaudible range, e.g., modulated into a very low frequency VAD signal or into high frequency VAD signal. The audio watermarking can be implemented by adding audio watermarking pre-processing in the external device, e.g., the headset, which encodes the continuous VAD signal; and also adding audio watermarking post-processing in the primary device, e.g., the handset, which decodes the audio data to extract the continuous VAD signal from the audio data.

The handset 404 may be a portable wireless communication device, such as a cellular phone, gaming device, or PDA, including a secondary wireless communication interface, preferably a Bluetooth interface.

The headset 402 is a wireless headset, preferably a Bluetooth headset. The headset 402 and handset 404 communicate with one another over a short-range wireless link, e.g., Bluetooth. Digitized audio may be transferred between the headset 402 and handset 404 using conventional Bluetooth profiles (e.g., the HSP) and protocols, as defined by the Bluetooth specification, where the Bluetooth packet headers may be modified to include the external VAD flag in some configurations.

Figure 6:
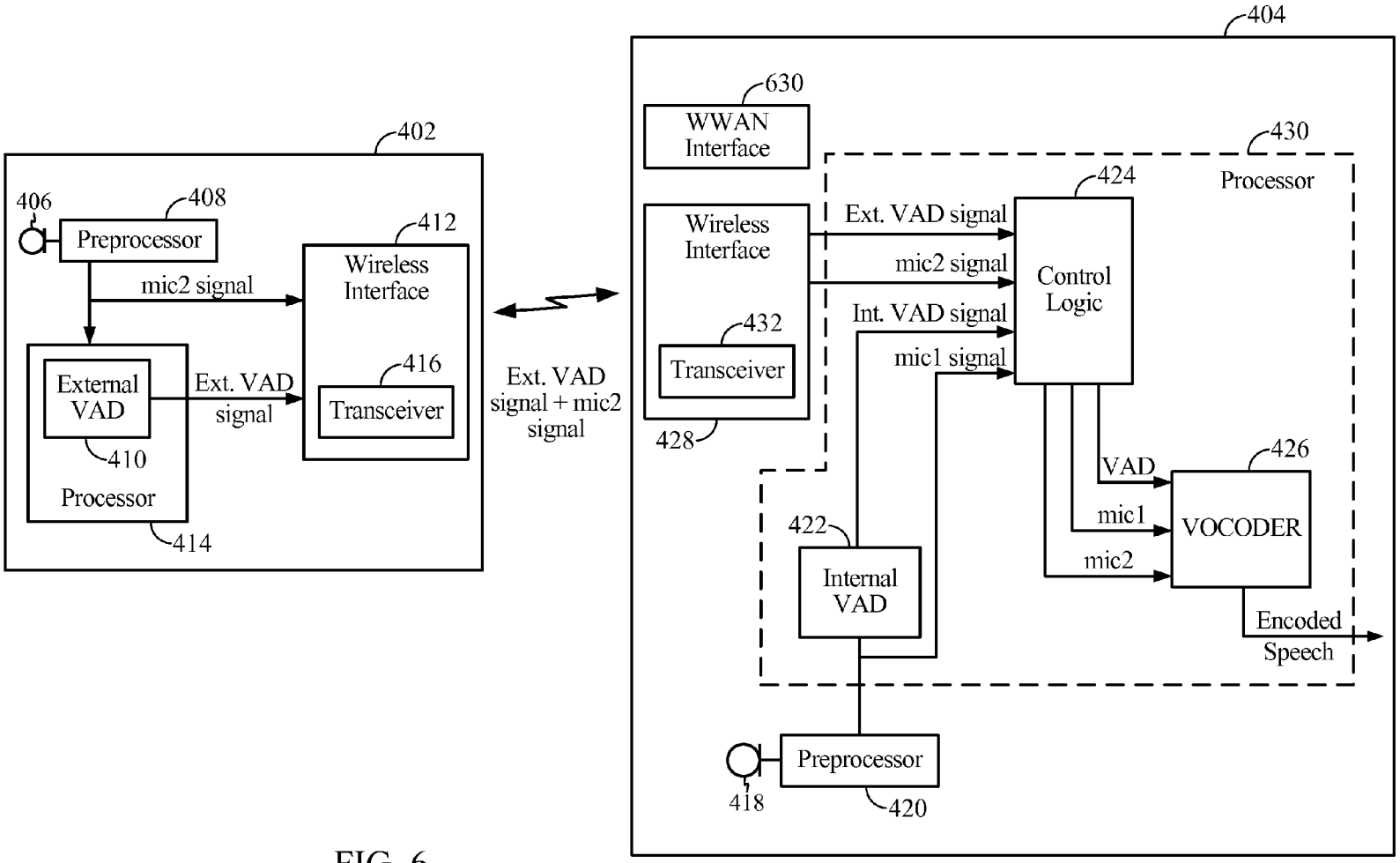
FIG. 6 is a block diagram showing certain components included in the headset and handset of FIG. 5.

FIG. 6 is a block diagram showing certain components included in the headset 402 and handset 404 of FIG. 5.

The headset 402 includes one or more microphones 406, a microphone preprocessor 408, an external VAD 410, and a wireless interface 412. The wireless interface 412 includes a transceiver 416. The microphone preprocessor 408 is configured to process electronic signals received from the microphone 406. The microphone preprocessor 408 may include an analog-to-digital converter (ADC) and other analog and digital processing circuitry. The ADC converts analog signals from the microphone 406 into digital signals. These digital signals may then be processed by the wireless interface 412. The microphone preprocessor 408 may be implemented using commercially-available hardware, software, firmware, or any suitable combination thereof.

The headset 402 may also or alternatively include one or more jaw or skin vibration sensors, and/or electro-magnetic (EM), e.g., Doppler radar sensors for detecting voice activity. The output(s) of these sensors are provided to the external VAD 410 in lieu of or in combination with the microphone signal (mic2 signal).

The wireless interface 412 provides two-way wireless communications with the handset 404 and other devices, if needed. Preferably, the wireless interface 412 includes a commercially-available Bluetooth module that provides at least a Bluetooth core system consisting of a Bluetooth RF transceiver, baseband processor, protocol stack, as well as hardware and software interfaces for connecting the module to a controller, such as the processor 414, in the headset 402. Although any suitable wireless technology can be employed with the headset 402, the transceiver 416 is preferably a Bluetooth transceiver. The wireless interface 412 may be controlled by the headset controller (e.g., the processor 414).

The external VAD 410 can be implemented by the processor 414 executing software code. The external VAD 410 may be any suitable device that implements a VAD algorithm, including any of the VAD algorithms described herein. The external VAD 410 outputs an external VAD signal based on the inputs from the microphones 406 or other sensors. The external VAD signal is then embedded into a Bluetooth audio packet header as a single bit flag, as described above, by the processor 414. In alternative configurations of the headset/ handset system, the processor 414 encodes the VAD signal on the digitized mic2 signal using an audio watermarking algorithm.

The wireless interface 412 transfers the digitized mic2 signal and external VAD signal in Bluetooth audio packets to the wireless interface 428 of the handset 404 over the Bluetooth wireless link.

The processor 414 can be any suitable computing device, such as a microprocessor, e.g., an ARM7, a digital signal processor (DSP), one or more application specific integrated circuits (ASICs), field programmable gate arrays (FPGAs), complex programmable logic devices (CPLDs), discrete logic, or any suitable combination thereof.

The handset 404 includes one or more microphones 418, a microphone preprocessor 420, an internal VAD 422, control logic 424, vocoder 426, and a wireless interface 428. The wireless interface 428 includes a transceiver 432.

The wireless interface 428 provides two-way wireless communications with the headset 402 and other devices, if needed. Preferably, the wireless interface 428 includes a commercially-available Bluetooth module that provides at least a Bluetooth core system consisting of a Bluetooth RF transceiver, baseband processor, protocol stack, as well as hardware and software interfaces for connecting the module to a controller, such as the processor 430, in the handset 404. Although any suitable wireless technology can be employed with the handset 404, the transceiver 432 is preferably a Bluetooth transceiver. The wireless interface 428 may be controlled by a handset controller (e.g., the processor 430).

The internal VAD 422, control logic 424, and vocoder 426 can be implemented by the processor 430 executing software code. The processor 430 can be any suitable computing device, such as a microprocessor, e.g., an ARM7, a digital signal processor (DSP), one or more application specific integrated circuits (ASICs), field programmable gate arrays (FPGAs), complex programmable logic devices (CPLDs), discrete logic, or any suitable combination thereof.

The control logic 424 is responsive to VAD signals from the external VAD 410, and the internal VAD 422 and the digitized microphone signals from the headset microphone 406 (mic 2 signal) and handset microphone 418 (mic 1 signal). The control logic 424 outputs a VAD output signal, which is provided to the vocoder 426. The control logic 424 may combine the external and internal VAD signals by weighting them to produce the VAD output signal. Weighting of the VAD signals may be performed as described herein above, and the weighting factors applied to each VAD signal may be based on environmental operating conditions measured by one or more sensor (not shown) included in either the handset 404 or headset 402, as described herein above.

The vocoder 426 detects voice activity based on the VAD output signal. Voice activity may be determined for each audio packet on a packet-by-packet basis. The VAD output signal is provided to the vocoder 426, which compares the VAD output signal to a threshold to determine whether voice is present in the audio signal (packet) being processed by the vocoder 426.

The control logic 424 also provides the digitized audio signals (mic 1 and mic 2 signals) from the microphones 406, 418 to the vocoder 426 for processing and encoding. The vocoder 426 can select which microphone signal to process, depending on which microphone 406, 418 is currently being used to receive speech. An encoded speech (voice) signal is output by the vocoder 426. The vocoder 426 can implement any suitable voice coding algorithm, including but not limited to the EVRC specified by the 3GPP2. The encoded speech can then be transmitted to the WWAN using the WWAN interface 630.

The handset 404 also includes a wireless wide area network (WWAN) interface 630 that comprises the entire physical interface necessary to communicate with a WWAN, such as a cellular network. The WWAN interface 630 includes a wireless transceiver configured to exchange wireless signals with base stations in a WWAN. The WWAN interface 630 exchanges wireless signals with the WWAN to facilitate voice calls and data transfers over the WWAN to a connected device. The connected device may be another WWAN terminal, a landline telephone, or network service entity such as a voice mail server, Internet server or the like. Examples of suitable wireless communications networks include, but are not limited to, code-division multiple access (CDMA) based networks, WCDMA, GSM, UTMS, AMPS, PHS networks or the like.

Figure 7:
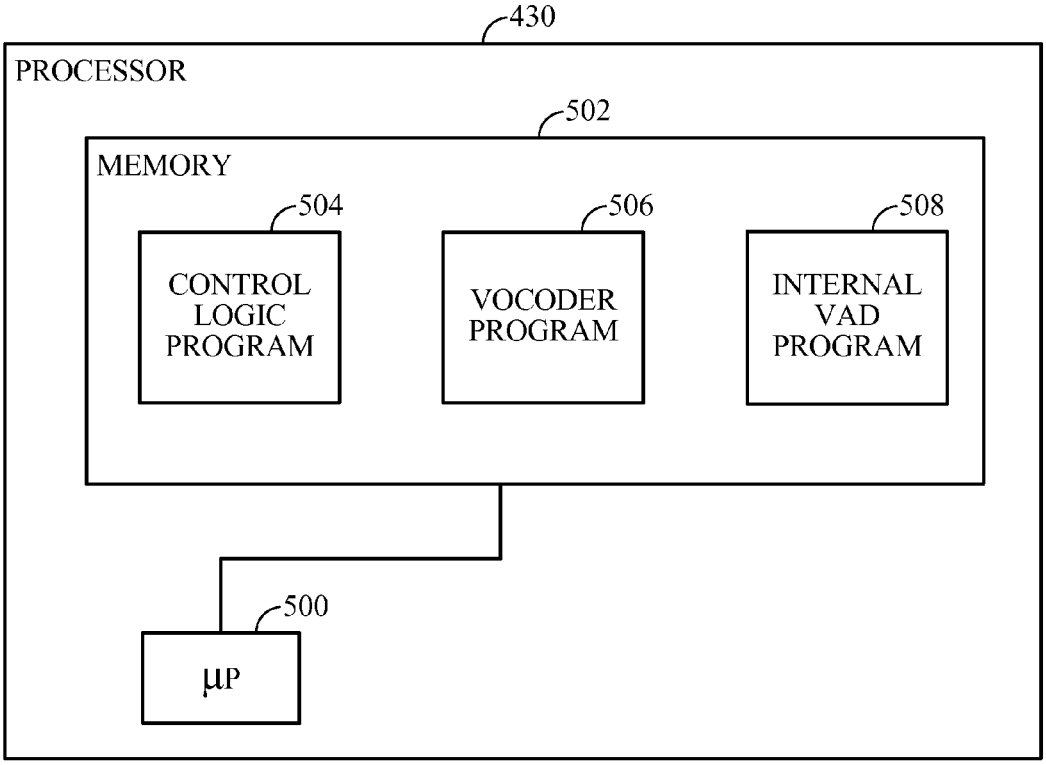
FIG. 7 is a block diagram showing certain components of the handset processor shown in FIG. 6.

FIG. 7 is a block diagram showing certain components of the handset processor 430 shown in FIG. 6. The processor 430 includes a microprocessor (uP) 500 connected to a memory 502. The memory 502 stores a control logic program 504, a vocoder program 506 and an internal VAD program 508. The control logic program 504 includes software/firmware code that when executed by the uP 500 provides the functionality of the control logic 424. The vocoder program 506 includes software/firmware code that when executed by the uP 500 provides the functionality of the vocoder 426. The internal VAD program 508 includes software/firmware code that when executed by the uP 500 provides the functionality of the internal VAD 422. Although illustrated as being separate programs, the control logic, vocoder and internal VAD programs 504, 506, 508 can be combined as one or more programs.

The memory 502 and microprocessor 500 can be coupled together and communicate on a common bus. The memory 502 and microprocessor 500 may be integrated onto a single chip, or they may be separate components or any suitable combination of integrated and discrete components. In addition, other processor-memory architectures may alternatively be used, such as a multiprocessor and/or multi memory arrangement.

The microprocessor 500 can be any suitable processor or controller, such as an ARM7, DSP, one or more application specific integrated circuits (ASICs), field programmable gate arrays (FPGAs), complex programmable logic devices (CPLDs), discrete logic, or any suitable combination thereof.

Alternatively, a multi-processor architecture having a plurality of processors, such as a microprocessor-DSP combination, may be used to implement the processor 430 in the handset 404. In an exemplary multi-processor architecture, a DSP can be programmed to provide at least some of the audio processing, such as the internal VAD 422, control logic 424 and vocoder 426 functions, and a microprocessor can be programmed to control overall operating of the handset 404.

The memory 502 may be any suitable memory device for storing programming code and/or data contents, such as a flash memory, RAM, ROM, PROM or the like.

The VAD system 10 may also be employed in other systems, for example, in a handset-carkit. In this scenario, the multiple microphones used in the carkit allow for source localization and directionality information to be accurately estimated. This information can be used to suppress noises or unwanted signals. It can be also used to estimate an external VAD signal. This external VAD signal can be sent to the handset that then uses the additional VAD information to enhance the handset's vocoder performance.

Another operational scenario in which the VAD system 10 can be employed is with a conference call speakerphone-handset combination. In this case, the external VAD device is included in a speakerphone device that is either wired or wirelessly connected to the handset. The speakerphone device can use multiple microphones to estimate the VAD of the voice source of interest. The source VAD signal can then be sent to the handset, which then uses the additional VAD information to enhance the handset's vocoder performance.

The functionality of the systems, devices, headsets, handsets and their respective components, as well as the method steps and blocks described herein may be implemented in hardware, software, firmware, or any suitable combination thereof. The software/firmware may be a program having sets of instructions (e.g., code segments) executable by one or more digital circuits, such as microprocessors, DSPs, embedded controllers, or intellectual property (IP) cores. If implemented in software/firmware, the functions may be stored on or transmitted over as instructions or code on one or more computer-readable media. Computer-readable medium includes both computer storage medium and communication medium, including any medium that facilitates transfer of a computer program from one place to another. A storage medium may be any available medium that can be accessed by a computer. By way of example, and not limitation, such computer-readable medium can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable medium.

Certain embodiments have been described. However, various modifications to these embodiments are possible, and the principles presented herein may be applied to other embodiments as well. For example, the principles disclosed herein may be applied to other devices, such as wireless devices including personal digital assistants (PDAs), personal computers, stereo systems, video games and the like. Also, the principles disclosed herein may be applied to wired headsets, where the communications link between the headset and another device is a wire, rather than a wireless link. In addition, the various components and/or method steps/blocks may be implemented in arrangements other than those specifically disclosed without departing from the scope of the claims.

Other embodiments and modifications will occur readily to those of ordinary skill in the art in view of these teachings. Therefore, the following claims are intended to cover all such embodiments and modifications when viewed in conjunction with the above specification and accompanying drawings.

What is claimed is:

1. A method of voice activity detection (VAD), comprising:

receiving a first VAD signal from a first voice activity detector included in a device;

receiving a second VAD signal from a second voice activity detector not included in the device;

combining the first and second VAD signals into a VAD output signal; and detecting voice activity based on the VAD output signal.

2. The method of claim 1, further comprising:

weighting the first VAD signal based on environmental conditions.

3. The method of claim 2, wherein the environmental conditions include a signal-to-noise ratio (SNR) measured at the device.

4. The method of claim 1, further comprising:

weighting the second VAD signal based on environmental conditions.

5. The method of claim 4, wherein the environmental conditions include a signal-to-noise ratio (SNR) measured at an external device including the second voice activity detector.

6. The method of claim 1, further comprising:

determining a function of the second voice activity detector.

7. The method of claim 6, wherein the function of the second voice activity detector is based on a bone conduction microphone, an audio microphone, a skin vibration sensor, an array of microphone, or a radar signal.

8. The method of claim 1, further comprising:

transmitting the second VAD signal over a wireless link.

9. The method of claim 8, wherein the wireless link is a Bluetooth wireless link.

10. A method of voice activity detection (VAD), comprising:

providing a first device and a second device, each device configured to communicate with one another by way of a wireless link;

determining a VAD signal in the second device;

at the second device, setting a flag based on the VAD signal, the flag being included in a packet containing digitized audio, wherein the flag is a one-bit value included in a Bluetooth packet header;

transmitting the packet from second device to the first device by way of the wireless link; and detecting voice activity at the first device based on the flag included in the packet.

11. A system, comprising:

a first voice activity detector included in a device, configured to produce a first voice activity detection (VAD) signal;

a second voice activity detector not included in the device, configured to produce a second voice activity detection (VAD) signal; and control logic, in communication with the first and second voice activity detectors, configured to combine the first and second VAD signals into a VAD output signal.

12. The system of claim 11, further comprising:

a processor receiving the VAD output signal.

13. The system of claim 12, wherein the processor includes a vocoder.

14. The system of claim 11, wherein the device is a wireless handset.

15. The system of claim 11, wherein the second voice activity detector is included in a headset in communication with the device.

16. The system of claim 15, wherein the headset is a wireless headset.

17. The system of claim 11, wherein the second VAD signal is transmitted to the control logic as a single bit value included in a Bluetooth header.

18. The system of claim 12, wherein the control logic is included in the device.

19. A system, comprising:

first means for detecting voice activity at a first location;

second means for detecting voice activity at a second location; and means for combining output from the first and second means into a voice activity detection (VAD) output signal.

20. The system of claim 19, further comprising:

processor means for receiving the VAD output signal.

21. The system of claim 19, wherein the first means is included in a wireless handset.

22. The system of claim 19, wherein the second means is included in a headset in communication with a device.

23. The system of claim 22, wherein the headset is a wireless headset.

24. The system of claim 19, further comprising means for transmitting a VAD signal from the first or second means to the means for combining as a single bit value included in a Bluetooth header.

25. The system of claim 19, wherein the means for combining is included at the first location.

26. A non-transitory computer-readable medium embodying a set of instructions executable by one or more processors, comprising:

code for receiving a first VAD signal from a first voice activity detector included in a device;

code for receiving a second VAD signal from a second voice activity detector not included in the device; and code for combining the first and second VAD signals into a VAD output signal.

27. The computer-readable medium of claim 26, further comprising:

code for detecting voice activity based on the VAD output signal.

28. The computer-readable medium of claim 26, further comprising:

code for weighting the first VAD signal based on environmental conditions.

29. The computer-readable medium of claim 28, wherein the environmental conditions include a signal-to-noise ratio (SNR) measured at the device.

30. The computer-readable medium of claim 26, further comprising:

code for weighting the second VAD signal based on environmental conditions.

31. The computer-readable medium of claim 30, wherein the environmental conditions include a signal-to-noise ratio (SNR) measured at an external device including the second voice activity detector.

* * * * *